United States Patent [19]

Jones et al.

[11] 4,095,928

[45] Jun. 20, 1978

[54] METHOD OF REDUCING NITROGEN OXIDE EMISSIONS IN FLUE GAS

[75] Inventors: Dale A. Jones, Whittier; Mansour N. Mansour, Hacienda, both of Calif.

[73] Assignee: Southern California Edison Company, Rosemead, Calif.

[21] Appl. No.: 768,579

[22] Filed: Feb. 14, 1977

[51] Int. Cl.[2] ..... F23C 7/00

[52] U.S. Cl. ..... 431/8; 431/2; 431/10

[58] Field of Search ..... 431/2, 3, 4, 8, 9, 10, 431/284, 285, 115, 116, 278

[56] References Cited

U.S. PATENT DOCUMENTS

| | | | |
|---|---|---|---|
| 3,376,098 | 4/1968 | Pryor | 431/10 |
| 3,729,285 | 4/1973 | Schwedersky | 431/8 |
| 3,907,488 | 9/1975 | Tekahashi | 431/2 |
| 3,914,091 | 10/1975 | Yamagishi et al. | 431/10 |

FOREIGN PATENT DOCUMENTS

| | | | |
|---|---|---|---|
| 1,551,780 | 12/1967 | Germany | 431/8 |

*Primary Examiner*—Edward G. Favors
*Attorney, Agent, or Firm*—Lyon & Lyon

[57] ABSTRACT

A process for the simultaneous combustion of nitrogen-rich fuels and nitrogen-poor fuels which results in the production of less nitrogen oxide emissions.

26 Claims, 3 Drawing Figures

METHOD OF REDUCING NITROGEN OXIDE EMISSIONS IN FLUE GAS

BACKGROUND OF THE INVENTION

The present invention relates to the method of reducing emissions of nitrogen oxides and, in particular, relates to a method of reducing nitrogen oxide emissions resulting from burning nitrogen containing fuels.

In recent years, there has been a growing concern over the problem of air pollution. This problem has become acute in industrialized urban areas of the country. There are a variety of sources of air pollution such as the internal combustion engine, chemical and metallurgical plants, power generating plants, etc. One of the more serious pollutants is the nitrogen oxides such as NO and $NO_2$ (hereinafter referred to collectively as "$NO_x$"). The nitrogen oxides contribute to air pollution by the formation of photochemical smog.

A source of $NO_x$ emissions is fuel burning plants such as power generating plants, incinerators, etc. In fuel burning plants, there are two sources of $NO_x$ emissions. The first source of $NO_x$ emissions originates from the thermal fixation of atmospheric nitrogen at the elevated temperatures obtained during the combustion process. The second source of $NO_x$ emissions originates from the thermal conversion of some of the organically-bound nitrogen in the hydrocarbon fuel to $NO_x$ during the combustion process. In most cases, depending upon the combustion technique, about 15 to about 30% of the organically-bound nitrogen is converted to $NO_x$. Unfortunately, commercial methods of denitrification consume relatively large amounts of hydrogen and are thus an expensive and inefficient method of removing organically-bound nitrogen from hydrocarbon fuel. In several areas where air quality control regulations have been promulgated, inexpensive high nitrogen containing fuels cannot be burned in fuel burning plants. This is a substantial problem because there exists a shortage of inexpensive low nitrogen containing fuels. Thus, there is a significant need for a method to reduce $NO_x$ emissions from the combustion of high nitrogen fuels in fuel burning plants.

One prior method of reducing $NO_x$ emissions from fuel burning plants comprises blending fuels containing a small amount of organically-bound nitrogen with fuels containing larger amounts of organically-bound nitrogen to obtain a fuel mixture having a more acceptable amount of nitrogen. However, this method requires the use of substantially greater amounts of low nitrogen containing fuels than high nitrogen containing fuels to obtain a mixture having an acceptable level of nitrogen. Alternatively, this method requires the consumption of large amounts of hydrogen in commercial denitrification processes to reduce the nitrogen content of the fuel at a relatively high refining cost.

Another prior method of reducing $NO_x$ emissions from fuel burning plants comprises off-stoichiometric combustion of the fuel. This type of combustion was accomplished in a furnace having two sets of burners which were vertically spaced apart. Fuel-rich combustion was carried on in the lower burners and air-rich combustion was simultaneously carried on in the upper burners.

In fuel-rich combustion, the oxygen selectively reacts with the hydrocarbon fuel due to the oxygen deficient atmosphere, thereby reducing the flame temperature and the amount of thermal fixation of atmospheric nitrogen. The fuel-rich combustion also results in the formation of relatively stable reduced nitrogen species. The formation of these more stable nitrogen species minimizes the conversion of organically-bound nitrogen in the fuel into $NO_x$. Unfortunately, the fuel-rich combustion also causes thermal cracking of the unburned fuel, thereby resulting in the formation of a significant amount of condensable carbon or smoke. To avoid giving off smoke, the upper burners were operated in an air-rich manner. The air-rich combustion functioned to completely burn any unburned fuel in the combustion gases from the fuel-rich combustion. However, the excess amount of oxygen provided to the upper burners resulted in increased conversion of the organically-bound nitrogen into $NO_x$ from the fuel supplied to the upper burners. Thus, a method which will produce a further reduction of $NO_x$ emissions is still required.

SUMMARY OF THE INVENTION

It is therefore the object of the present invention to provide a method for the combustion of nitrogen containing hydrocarbon fuel which will result in a significant reduction in $NO_x$ emissions.

This and other objects and advantages are obtained by simultaneous combustion of fuels containing different amounts of organically-bound nitrogen (fuel nitrogen). In its preferred embodiment, the process is carried out with a nitrogen-rich and a nitrogen-poor fuel in a furnace having two aligned sets of burners which are vertically spaced apart. The nitrogen-rich fuel is burned in the lower burners and the nitrogen-poor fuel is simultaneously burned in the upper burners. The process results in combustion effluents having reduced $NO_x$ concentrations. In one preferred method the nitrogen-rich fuel is burned in a fuel-rich manner and the nitrogen-poor fuel is burned in a stoichiometric or air-rich manner.

A more thorough disclosure of the objects and advantages of the present invention is presented in the detailed description which follows.

DETAILED DESCRIPTION OF THE INVENTION

Figure 1:
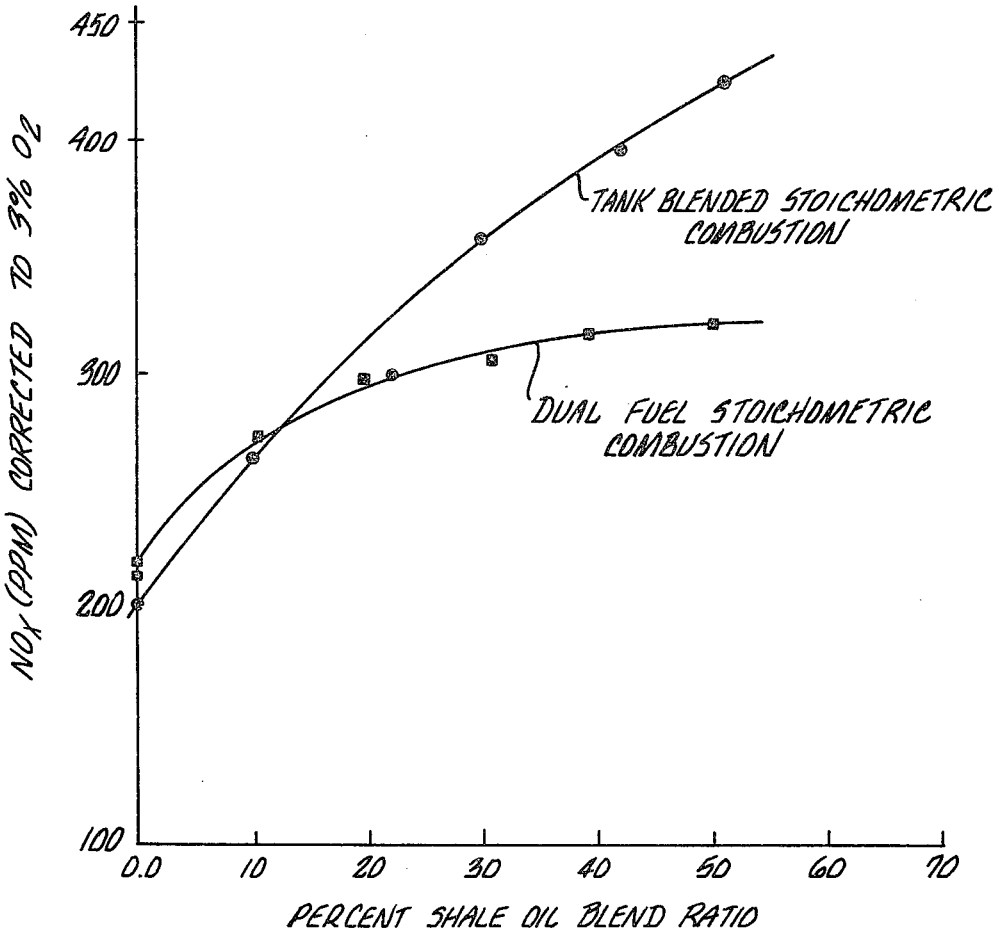

The present invention contemplates a process for reducing $NO_x$ emissions from fuel burning plants comprising simultaneous combustion of a plurality of fuels having differing amounts of organically-bound nitrogen. In the process, combustion of nitrogen-rich fuels occurs in a first group of burners. The nitrogen-poor fuels are simultaneously burned in a second group of burners which are positioned above the first group of burners so that the combustion gases from the burning of the nitrogen-rich fuel pass through the combustion zone of the second group of burners. The process results in combustion effluents having reduced $NO_x$ concentrations compared with the identical combustion of a homogeneous blend of the two fuels. In its preferred embodiment, the process is carried out with a nitrogen-rich fuel and a nitrogen-poor fuel in a furnace having two sets of burners which are vertically spaced apart. Preferably, the process in one embodiment comprises off-stoichiometric combustion wherein the nitrogen-rich fuel is burned in the lower burner in a fuel-rich manner and the nitrogen-poor fuel is simultaneously burned in the upper burner in a stoichiometric or air-rich manner. However, it had also been found that operating both burners at stoichiometric will also produce results heretofore unobtainable with prior art processes.

Various fuels may be utilized in the practice of the present invention. Suitable nitrogen-rich fuels are petroleum coke, asphaltane, crude oil, solvent refined coal and coal liquefication residues, synthetic oil from coal, oil shale and tar sands, a coal or petroleum coke-oil slurry (i.e. 40%/60%), or pulverized raw coal which may be blown into the furnace. Suitable nitrogen-rich fuels have a nitrogen content of about 1.0 to about 2.5% by weight. One suitable group of nitrogen-poor fuels having a 0% nitrogen content are natural gas or synthetic natural gas from coal gasification, or low or medium BTU gas from gasification of coal, petroleum coke and oil slurries thereof, tar sands, or coal liquefication residue. Another suitable group of nitrogen-poor fuels having a nitrogen content from about 0.005 to about 0.6% by weight are number two petroleum distillate, crude oil, refined light distillate liquid fuel from coal or oil shale, low sulfur oil and denitrified synthetic fuels. In view of the above it will be apparent to those skilled in the art that other suitable combinations of nitrogen-rich and nitrogen-poor fuels may also be utilized in the practice of the present invention, although it is believed that the process is more effective in preventing the formation of $NO_x$ emissions when there is a greater difference in the nitrogen content between the nitrogen-rich and the nitrogen-poor fuels.

Suitable furnaces for use in the practice of the present invention are provided with a plurality of burners or sets of burners which are spaced apart and positioned such that the combustion gases from a first burner or set of burners pass through the combustion zones of successive burners or sets of burners. Preferably, the burners are positioned above each other to enable the combustion gases to pass through the combustion zone of successive burners by virtue of convective currents within the furnace. Each burner or set of burners is provided with its own fuel supply pipe. Thus each burner or set of burners may be supplied with a specific type of fuel. Specific types of fuels may be easily stored or segregated in specific tanks, or storage areas. Suitable furnaces for the practice of the present invention include solid, liquid and gas burning boilers, gas turbine combustors, fluidized bed, entrained bed or rotating bed reactors. It will, however, be obvious to one skilled in the art that other types of suitable furnaces may also be utilized in the practice of the present invention.

In the practice of the present invention it is preferred that the nitrogen-rich fuels be burned in a fuel-rich manner while the nitrogen-poor fuels be burned in a stoichiometric or air-rich manner. Preferably, the nitrogen-poor fuel is only burned in an air-rich manner if it has a nitrogn content below about 0.15% by weight and preferably has a nitrogen content of about 0% by weight. Alternatively, as described hereinafter, the nitrogen-poor fuel may also be burned in a fuel-rich manner.

In normal or stoichiometric combustion, the fuel is burned in an atmosphere containing about 115% of the theoretical amount of air necessary to enable complete combustion. In the fuel-rich combustion, the nitrogen-rich fuels are preferably burned in an atmosphere containing about 80 to about 105% of the theoretical amount of air needed for complete combustion with 90% being generally optimum. In air-rich combustion, suitable nitrogen-poor fuels are preferably burned in an atmosphere containing about 120 to about 150% of the theoretical amount of air necessary to enable complete combustion. Preferably, the average value of the amount of air which is passed into the furnace is about 115% of the theoretical amount of air necessary to enable complete combustion of all of the fuel. Thus, when two sets of burners are used with equal amounts of fuel provided to each set, and when the fuel-rich combustion was conducted at about 90% air, the air-rich combustion would be maintained at about 140% air to provide an overall average value of 115% of the theoretical amount of air necessary to enable complete combustion of all of the fuel.

Alternatively, if two nitrogen-rich fuels are burned in the two lowers sets of a three burner set furnace and the nitrogen-poor fuel is burned in the top set of burners, the air to fuel ratio may be adjusted to provide, for example, in the lower burner a 95% air for the richest nitrogen fuel, 105% air in the middle burner for the other nitrogen-rich fuel and 145% air for the combustion of the nitrogen-poor fuel.

Fuel-rich or air-rich combustion can be accomplished by either closing down or opening up the air dampers surrounding the burners, thereby enabling a proper amount of air to enter the furnace. The flow rates of fuel through the bottom fuel-rich burners may also be increased and conversely decreased in the top burners to create the proper combustion conditions with equal amounts of air being supplied to all the burners. Various adjustments of air and fuel flow rates between top and bottom burners may also be used to achieve the proper combustion conditions.

In another alternative embodiment, in a three or more burner set furnace, the nitrogen-rich fuel may be burned in a fuel-rich manner in the lower set of burners and the nitrogen-poor fuel may be burned in a stoichiometric or fuel-rich manner in the top set of burners. The middle set of burners are utilized merely to introduce the additional requisite amount of air into the furnace to enable complete combustion of all of the fuel, thereby preventing the formation of condensable carbon or smoke. This method of combustion enables fuel-rich burning of essentially all of the fuel within the furnace thereby even further reducing the $NO_x$ concentration in combustion effluents. In an alternative embodiment, a plurality of air inlet ports may alternatively be utilized to enable the introduction of the additional air into the furnace. The air is introduced into the furnace between the two sets of burners or on the same level as the top set of burners. Preferably, the air is introduced into the furnace directly above the bottom set of burners.

Although the chemistry of the present process is not fully understood, it is believed that the combustion of the nitrogen-rich fuel in the lower burners in the oxygen-starved environment results in the formation of only a minimal amount of $NO_x$ and further in the production from the fuel nitrogen of more stable nitrogen species such as ammonia, nitrogen and free radicals such as NH and $NH_2$. As these combustion gases rise in the furnace, they pass through the combustion zone of the upper burners. However, since the nitrogen-poor fuels contain very little organically-bound nitrogen, the combustion only results in the formation of a minimal amount of additional $NO_x$ emissions. It is also believed that some of the $NO_x$ emissions formed during the combustion process will react with the ammonia and nitrogen radicals at the elevated furnace temperatures to form nitrogen and water vapor. Thus, the process of the present invention results in the overall formation of significantly less $NO_x$ emissions.

The following are the results of tests which demonstrate that the combustion process of the present invention results in the production of less $NO_x$ emissions. It is to be understood that these results are given primarily by way of illustration and not of limitation. The tests were conducted on a fuel burning furnace used for steam generation. This steam generating furnace provided sufficient steam to a turbine/generator such that the boiler system provided 45 megawatts of electrical output at maximum capacity. This balanced-draft furnace was equipped with six burners each rated at 85 million Btu/hr. During the tests, the burners were operated collectively to produce sufficient steam for the electrical generation of approximately 41–43 megawatts. The six burners were grouped into two sets of three and the first set was positioned directly under the second set.

Referring to the table, tests 1–26 were conducted on low $NO_x$ burners similar to those disclosed in the Koppang U.S. Pat. No. 3,880,571, the disclosure of which is incorporated herein by reference. Each low $NO_x$ burner produced a thin conically-shaped flame which provided a large radiation surface enabling rapid dissipation of heat and minimizing thermal fixation of atmospheric nitrogen. The fuels were supplied to the low $NO_x$ burners through supply lines at a pressure of about 40 P.S.I.G. without the use of return lines. Tests 27–45 were conducted on standard burners manufactured and sold by Peabody Engineering, Inc. Three types of fuels were burned during the tests, nitrogen free natural gas, low sulfur oil having a nitrogen content of about 0.18% and shale oil having a nitrogen content of about 2.0%. In tests 1–40, low sulfur oil and shale oil were burned. In tests 41–45, natural gas was burned in the top row of burners and a mixture of low sulfur oil and shale oil was burned in the lower burners. The $NO_x$ concentrations in the effluent gases were measured utilizing Infrared Analyzers and Chemiluminescent Gas Analyzers and were corrected to 3% oxygen. The $NO_x$ emission data was also corrected for $NO_x$ contributions from thermal fixations of nitrogen. The fuel nitrogen conversion efficiency was calculated by the ratio of $NO_x$ emissions to the increase in $NO_x$ emissions which would have resulted if all the fuel nitrogen had been converted to $NO_x$.

Referring to the table, in tests 1–7 and 27–33, the fuels were segregated and burned in a stoichiometric manner according to the process of the present invention. In tests 16–21, the fuels were tank blended and burned in a stoichiometric manner. In tests 22–26, the fuels were tank blended and burned in an off-stoichiometric manner. In tests 8–15 and 34–45, the fuels were segregated and burned in an off-stoichiometric manner according to the process of the present invention. The results of these tests are illustrated in the following table and graphs.

| Test No. | Shale Oil Blend Percent of Total | Air to Fuel Ratio by Row | | Nitrogen Conversion Efficiency by Row | | $NO_x$ Corrected to 3% $O_2$ |
|---|---|---|---|---|---|---|
| | | Top | Bottom | Top | Bottom | |
| 1 | 0 | 17.9 | 18.3 | — | — | 212 |
| 2 | 0 | 17.94 | 18.37 | — | — | 219 |
| 3 | 11.0 | 17.79 | 18.12 | — | 25.3 | 273 |
| 4 | 20.1 | 18.81 | 17.73 | — | 19.3 | 296 |
| 5 | 31.2 | 17.86 | 17.86 | — | 13.9 | 307 |

-continued

| Test No. | Shale Oil Blend Percent of Total | Air to Fuel Ratio by Row | | Nitrogen Conversion Efficiency by Row | | $NO_x$ Corrected to 3% $O_2$ |
|---|---|---|---|---|---|---|
| | | Top | Bottom | Top | Bottom | |
| 6 | 39.8 | 17.98 | 17.89 | — | 12.2 | 319 |
| 7 | 50.1 | 18.0 | 17.5 | — | 10.2 | 323 |
| 8 | 0 | 19.55 | 14.7 | — | — | 175 |
| 9 | 11 | 18.75 | 14.12 | — | 22.4 | 215 |
| 10 | 17.1 | 18.24 | 13.8 | — | 17.4 | 224 |
| 11 | 26.3 | 18.55 | 13.95 | — | 14.6 | 238 |
| 12 | 39 | 18.56 | 13.69 | — | 13.7 | 262 |
| 13 | 49.2 | 18.59 | 13.61 | — | 11.9 | 271 |
| 14 | 66.7 | 18.75 | 13.62 | — | 11.4 | 299 |
| 15 | 0 | 18.7 | 14.1 | — | — | 184 |
| 16 | 0 | 17.5 | | — | — | 201 |
| 17 | 10.3 | 17.81 | | 28.8 | 28.8 | 265 |
| 18 | 22.5 | 17.51 | | 20.1 | 20.1 | 300 |
| 19 | 30.1 | 17.31 | | 22.9 | 22.9 | 351 |
| 20 | 42.3 | 17.12 | | 21.6 | 21.6 | 398 |
| 21 | 51.4 | 17.06 | | 20.3 | 20.3 | 426 |
| 22 | 0 | 15.72 | | — | — | 189 |
| 23 | 17.0 | 15.8 | | 25.1 | 22.7 | 262 |
| 24 | 30.5 | 15.9 | | 24.6 | 22.4 | 318 |
| 25 | 47.3 | 15.5 | | 21.9 | 19.9 | 366 |
| 26 | 59.6 | 15.4 | | 20.8 | 20.0 | 398 |
| 27 | 0 | 17.5 | 17.5 | — | — | 248 |
| 28 | 11.3 | 17.7 | 17.2 | — | 34.2 | 331 |
| 29 | 19.6 | 17.26 | 16.74 | — | 33.5 | 389 |
| 30 | 31.2 | 17.33 | 16.55 | — | 27.5 | 432 |
| 31 | 39.4 | 17.72 | 16.59 | — | 26.6 | 471 |
| 32 | 51.2 | 17.76 | 16.45 | — | 25.2 | 522 |
| 33 | 0 | 17.11 | 17.11 | — | — | 245 |
| 34 | 0 | 18.2 | 14.76 | — | — | 179 |
| 35 | 11.9 | 19.0 | 15.33 | — | 23.6 | 226 |
| 36 | 20.4 | 18.32 | 14.6 | — | 16.5 | 250 |
| 37 | 31.6 | 18.22 | 14.57 | — | 16.7 | 268 |
| 38 | 43.8 | 18.40 | 14.6 | — | 14.1 | 282 |
| 39 | 52.1 | 18.61 | 14.52 | — | 13.02 | 292 |
| 40 | 65.3 | 18.37 | 14.28 | — | 11.7 | 306 |
| 41 | 0 | — | — | — | — | 134 |
| 42 | 15.3 | — | — | — | — | 164 |
| 43 | 29.4 | — | — | — | — | 187 |
| 44 | 39.6 | — | — | — | — | 203 |
| 45 | 71.8 | — | — | — | — | 239 |

Referring to the data, it can be seen that the combustion process of the present invention results in a lower percent conversion of organically-bound nitrogen to $NO_x$ emissions in the combustion effluence. Referring to FIG. 1, the results of tests 1–7 are compared to the results of tests 16–21. From the drawing, it can be seen that segregation and burning of nitrogen-rich and nitrogen-poor fuels according to the process of the present invention results in less $NO_x$ emissions in the combustion effluence compared to the burning of a tank blended mixture of the two fuels. For example, at 51.4% shale oil, normal combustion of the tank blended mixture resulted in the production of combustion effluents having 426 PPM $NO_x$. However, dual fuel combustion of 50.1% shale oil resulted in only 323 PPM $NO_x$ in the combustion effluents. With regard to the data, it should be noted that at lower concentrations of shale oil, combustion of a tank blended mixture appears to result in less $NO_x$ emissions than the dual fuel combustion. In this regard, it should be noted that the test sequence began with the combustion of the tank blended mixture having 0% shale oil and terminated with the dual fuel combustion having 0% shale oil. Thus, it is believed that the higher $NO_x$ readings for dual fuel combustion at lower concentrations of shale oil is due to the residue of shale oil remaining in the feed pipes from the earlier tests of fuels containing greater amounts of shale oil.

Figure 2:
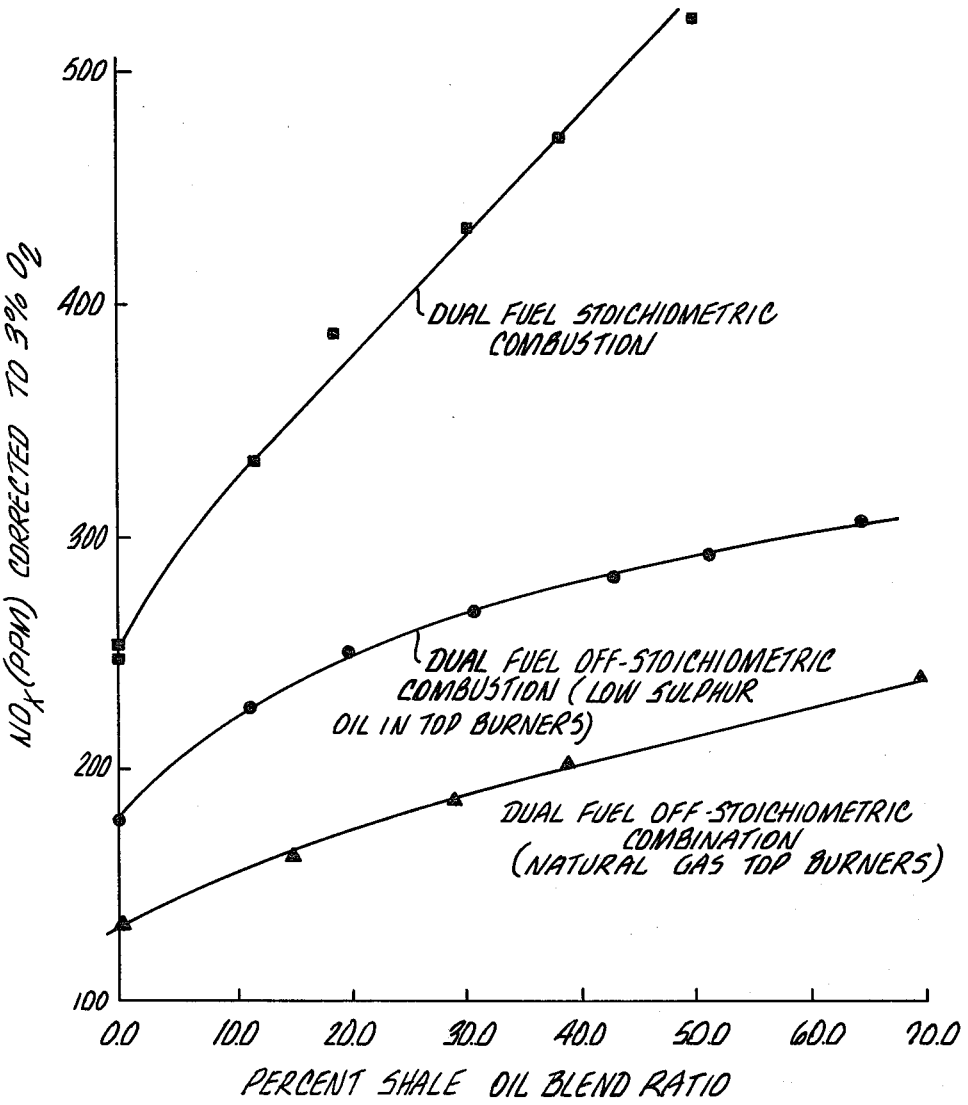

Referring to FIG. 2, the $NO_x$ emissions data for tests 27–45 are displayed. From the drawing, it can be seen that off-stoichiometric combustion of nitrogen-rich and nitrogen-poor fuel also results in substantially lower concentrations of $NO_x$ in the combustion effluents. Further, referring to tests 41–45, it can be seen that even lower concentrations of $NO_x$ in the combustion effluent can be obtained by burning a nitrogen-free fuel in the upper set of burners. Further, although the second group of tests (tests 27–45) were conducted with a burner which inherently produces more $NO_x$, it can be seen that off-stoichiometric combustion of nitrogen-rich and nitrogen-poor fuels result in the production of less $NO_x$ than normal combustion of nitrogen-rich and nitrogen-poor fuels on low $NO_x$ burners (tests 1–7). For example, comparing tests 3–5 with tests 35–37, it can be seen that even utilizing standard burners, off-stoichiometric combustion in combination with the combustion method of the present invention results in the production of substantially less $NO_x$ in the combustion effluence than normal dual fuel combustion utilizing low $NO_x$ burners.

Figure 3:
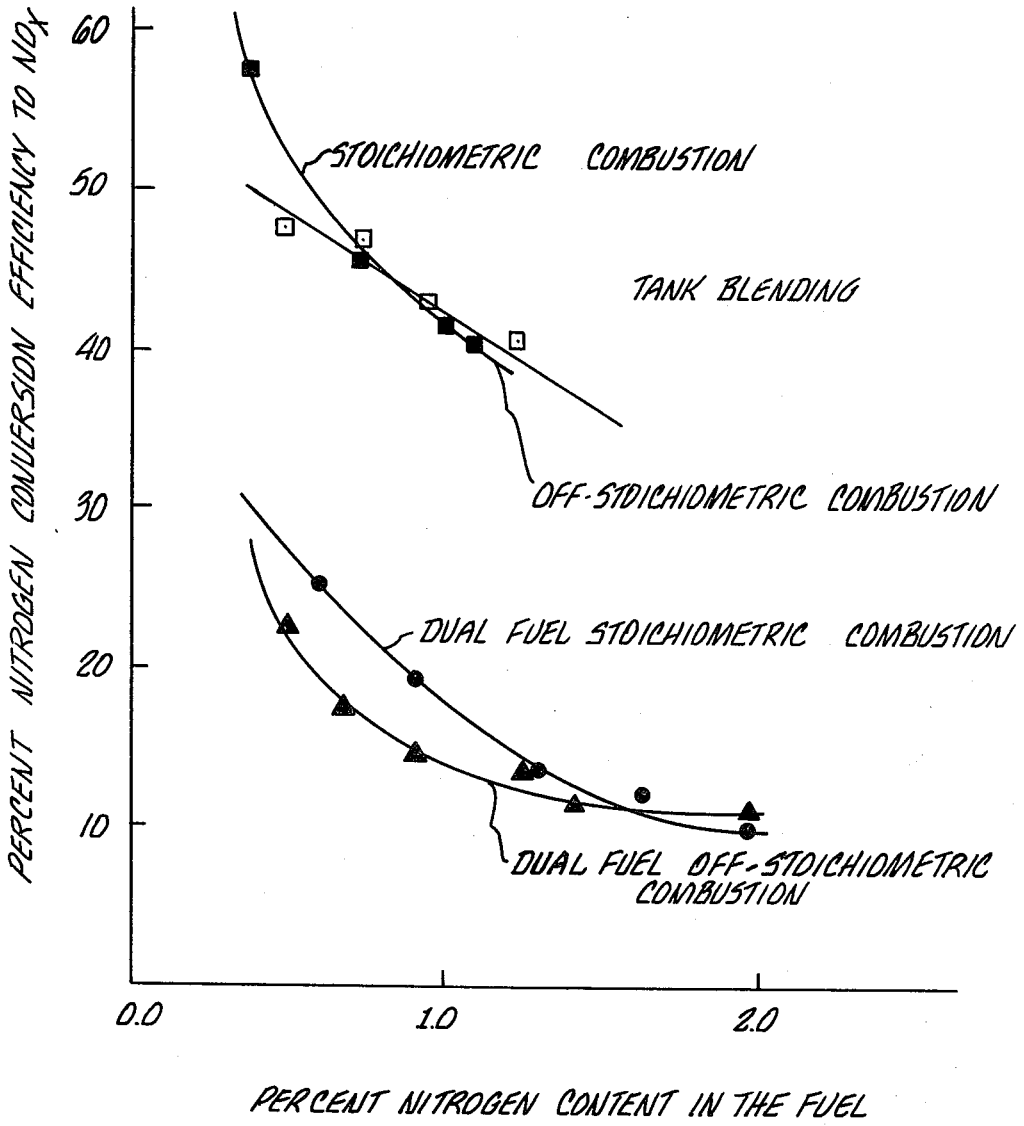

Lastly, referring to FIG. 3, it should be noted that the dual fuel method of combustion according to the present invention results in substantially less conversion of fuel nitrogen to $NO_x$ than normal or off-stoichiometric combustion of tank blended fuel. In this regard, it should be noted that the combustion process of the present invention inherenntly concentrates a greater amount of fuel nitrogen in the lower portion of the burner than does tank blending wherein nitrogen-rich fuel is also burned in the top row of burners. From the graph, it is apparent that the nitrogen conversion efficiency substantially decreases with increasing concentration of fuel nitrogen. Thus, the process of the present invention which concentrates fuel nitrogen in the lower portion of the furnace results in substantially less conversion of fuel nitrogen to $NO_x$.

While an embodiment and application of this invention has been shown and described, it will be apparent to those skilled in the art that many more modifications are possible without departing from the inventive concepts herein described. The invention, therefore, is not to be restricted except as is necessary by the prior art and by the spirit of the appended claims.

What is claimed is:

1. A method of reducing nitrogen oxide emissions from fuel burning, comprising:

burning in a first combustion zone nitrogen-rich fuels;

burning in a second combustion zone nitrogen-poor fuels; and burning both said fuels simultaneously and in a manner to cause the combustion gases from the burning of said nitrogen rich fuels to pass through said second combustion zone.

2. The method of claim 1 wherein said nitrogen-rich fuels have a nitrogen content of about 1.0% to about 2.5% by weight.

3. The method of claim 1 wherein said nitrogen-poor fuels have a nitrogen content of about 0 to about 0.6% by weight.

4. The method of claim 1 wherein said nitrogen-rich fuel is selected from the group consisting of crude oil, solvent refined coal, liquefication residues, synthetic oil from coal, synthetic oil from oil shale, synthetic oil from tar sands, coal-oil slurry, petroleum coke-oil slurry, asphaltene, pulverized petroleum coke, residual oil and raw coal.

5. The method of claim 1 wherein said nitrogen-poor fuel is selected from the group consisting of number two petroleum distillate, crude oil, refined light distillate liquid fuel from coal and oil shale, low sulfur oil, denitrified synthetic fuels, natural gas, synthetic natural gas from coal gasification and low and medium BTU gas from gasification of coal, petroleum coke and oil slurries thereof, tar sands and coal liquefication residue.

6. A method of reducing nitrogen oxide emissions from fuel burning comprising:

burning a nitrogen-rich fuel in a first burner means;

burning simultaneously a nitrogen-poor fuel in a second burner means, said second burner means being positioned above said first burner means so that the combustion gases from the burning of said nitrogen-rich fuel pass through the combustion zone of said second burner means.

7. A method of reducing nitrogen oxide emissions from fuel burning, comprising:

burning in a first combustion zone nitrogen-rich fuels in a fuel-rich manner;

burning in a second combustion zone nitrogen-poor fuels in an air-rich manner; and burning both said fuels simultaneously and in a manner to cause the combustion gases from the burning of said nitrogen-rich fuels to pass through said second combustion zone.

8. The method of claim 7 wherein said nitrogen-rich fuels are burned in an atmosphere having about 80% to about 105% of the theoretical amount of air needed to enable complete combustion of the fuel.

9. The method of claim 7 wherein said nitrogen-rich fuels are burned in an atmosphere containing about 90% of the theoretical amount of air needed to enable complete combustion of the fuel.

10. The method of claim 7 wherein said nitrogen-poor fuels are burned in an atmosphere containing about 120 to about 150% of the theoretical amount of air needed to enable complete combustion of the fuel.

11. The method of claim 7 wherein said nitrogen-rich fuels have a nitrogen content of about 1.0 to about 2.5% by weight.

12. The method of claim 7 wherein said nitrogen-poor fuels have a nitrogen content of about 0 to about 0.15% by weight.

13. The method of claim 11 wherein said nitrogen-rich fuel is selected from the group consisting of crude oil, solvent refined coal, liquefication residues, synthetic oil from coal, synthetic oil from oil shale, synthetic oil from tar sands, coal-oil slurry, petroleum coke-oil slurry, asphaltene, pulverized petroleum coke, residual oil and pulverized raw coal.

14. The method of claim 12 wherein said nitrogen-poor fuel is selected from the group consisting of natural gas, synthetic natural gas from coal gasification and low and medium BTU gas from gasification of coal, petroleum coke and oil slurries thereof, tar sands and coal liquefication residues.

15. A method of reducing nitrogen oxide emissions from fuel burning comprising:

burning a nitrogen-rich fuel having a nitrogen content of about 1.0 to about 2.5% by weight in a first burner means in an atmosphere containing about 80 to about 105% of the theoretical amount of air needed to enable complete combustion of the fuel;

burning simultaneously a nitrogen-poor fuel having a nitrogen content of about 0 to about 0.15% by weight in a second burner means in an atmosphere containing 120 to about 150% of the theoretical amount of air needed to enable complete combustion of the fuel, said second burner means being positioned directly above said first burner means so that the combustion gases from the burning of said nitrogen-rich fuel pass through the combustion zone of said second burner means.

16. A method of reducing nitrogen oxide emissions from fuel burning, comprising;

burning in a first combustion zone nitrogen-rich fuels in a stoichiometric manner;

burning in a second combustion zone nitrogen-poor fuels in a stoichiometric manner; and burning both said fuels simultaneously and in a manner to cause the combustion gases from the burning of said nitrogen-rich fuels to pass through said second combustion zone.

17. The method of claim 17 wherein said nitrogen-rich fuels have a nitrogen content of about 1.0 to about 2.5% by weight.

18. The method of claim 16 wherein said nitrogen-poor fuels have a nitrogen content of about 0 to about 0.6% by weight.

19. The method of claim 17 wherein said nitrogen-rich fuel is selected from the group consisting of crude oil, solvent refined coal, liquefication residues, synthetic oil from coal, synthetic oil from oil shale, synthetic oil from tar sands, coal-oil slurry and petroleum coke-oil slurry, asphaltene, pulverized petroleum coke, residual oil and pulverized raw coal.

20. The method of claim 18 wherein said nitrogen-poor fuel is selected from the group consisting of number two petroleum distillate, crude oil, refined light distillate liquid fuel from coal and oil shale, low sulfur oil denitrified synthetic fuels, natural gas, synthetic natural gas from coal gasification and low and medium BTU gas from gasification of coal, petroleum coke and oil slurries thereof, tar sands and coal liquefication residue.

21. A method of reducing nitrogen oxide emissions from fuel burning, comprising:

burning in a first combustion zone of a furnace nitrogen-rich fuels in a fuel-rich manner;

burning in a second combustion zone of a furnace nitrogen-poor fuels in a fuel-rich manner;

introducing air into said furnace between said first and said second combustion zone to enable complete combustion of said nitrogen-rich and nitrogen poor fuels; and burning both said fuels simultaneously and in a manner to cause the combustion gases from the burning of said nitrogen-rich fuels to pass through said second combustion zone.

22. The method of claim 21 wherein said nitrogen-rich fuels have a nitrogen content of about 1.0 to about 2.5% by weight.

23. The method of claim 21 wherein sai nitrogen-poor fuels have a nitrogen content of about 0 to about 0.6% by weight.

24. A method of reducing nitrogen oxide emissions from fuel burning, comprising:

burning in a first combustion zone of a furnace nitrogen-rich fuels in a fuel-rich manner;

burning in a second combustion zone of a furnace nitrogen-poor fuels in a stoichiometric manner;

introducing air into said furnace between said first and said second combustion zone to enable complete combustion of said nitrogen-rich and nitrogen-poor fuels; and burning both said fuels simultaneously and in a manner to cause the combustion gases from the burning of said nitrogen-rich fuels to pass through said second combustion zone.

25. The method of claim 24 wherein said nitrogen-rich fuels have a nitrogen content of about 1.0 to about 2.5% by weight.

26. The method of claim 24 wherein said nitrogen-poor fuels have a nitrogen content of about 0 to about 0.6% by weight.

* * * * *